US005505524A

United States Patent [19]

Drumwright

[11] Patent Number: 5,505,524

[45] Date of Patent: Apr. 9, 1996

[54] PORTABLE HAIR STYLING AND BARBER CHAIR

[76] Inventor: Kathy P. Drumwright, P.O. Box 493, South Hill, Va. 23970

[21] Appl. No.: 358,406

[22] Filed: Dec. 19, 1994

[51] Int. Cl.[6] ..... A47C 7/70

[52] U.S. Cl. ..... 297/440.24; 297/183.5; 297/17; 248/169; 248/171

[58] Field of Search ..... 297/440.24, 183.5, 297/344.19, 17; 248/171, 169, 161

[56] References Cited

U.S. PATENT DOCUMENTS

| | | | |
|---|---|---|---|
| 844,674 | 2/1907 | Gymer | 297/183.5 X |
| 897,737 | 9/1908 | Goodrich | 297/183.5 X |
| 1,493,467 | 5/1924 | Butt et al. | 297/183.5 X |
| 2,493,978 | 1/1950 | Kromer | 248/171 |
| 2,709,560 | 5/1955 | Resk | 248/169 |
| 2,794,612 | 6/1957 | Clifton | 248/171 X |
| 3,203,657 | 8/1965 | Thompson | 248/171 |
| 3,381,998 | 5/1968 | Cheshier et al. | 297/183.5 X |
| 3,422,938 | 1/1969 | Worcester | 297/17 X |
| 4,079,992 | 3/1978 | Thrift et al. | 297/183.5 |
| 4,474,407 | 10/1984 | Nazar | 297/183.5 X |
| 4,597,605 | 7/1986 | Gilbert | 297/183.5 X |
| 5,137,236 | 8/1992 | Burns | 248/171 |

FOREIGN PATENT DOCUMENTS

| | | | |
|---|---|---|---|
| 642299 | 8/1950 | United Kingdom | 248/171 |

*Primary Examiner*—Jose V. Chen
*Assistant Examiner*—Rodney B. White
*Attorney, Agent, or Firm*—Michael I. Kroll

[57] ABSTRACT

A portable hair styling and barber chair comprising a lightweight collapsible tetrapod base unit. A lightweight foldable seat assembly fits upon the base unit. When the seat assembly is disassembled from the base unit, the chair can be carried with little effort from place to place and can conveniently fit into a trunk of an automobile.

1 Claim, 3 Drawing Sheets

PORTABLE HAIR STYLING AND BARBER CHAIR

DESCRIPTION OF THE PRIOR ART

Numerous tripods and chairs have been provided in prior art. For example, U.S. Pat. Nos. 730,062 to Widmer; 2,668,682 to Dalton; 3,827,750 to Fantoni; 5,040,522 to Daniels; Des. 249,102 to Pelly; Des. 327,041 to Kuhl et al.; Des. 336,791 to Stidd and Des. 350,649 to Rozum all are illustrative of such prior art. While these units may be suitable for the particular purpose to which they address, they would not be as suitable for the purposes of the present invention as heretofore described.

WIDMER, CHARLES J.

FOLDING STAND

U.S. Pat. No. 730,062

The invention relates to music stands or the like, and particularly to an arrangement of the device, whereby extensible and folding legs may be properly associated with a central rod or bar or tube intended to support a music stand or the like.

DALTON, BRUCE H.

FOLDING TRIPOD CONSTRUCTION

U.S. Pat. No. 2,668,682

A tripod of light and rigid construction has adjustable feet by which it may be adapted for use either on a flat interior floor such as a hardwood or marble floor, or alternatively, can be adjusted for use on rough ground. A good construction incorporates a universal joint, thus allowing the feet to accommodate to different angular adjustments of the tripod or uneven ground. In each adjustable foot is a means to present either a flat support surface for use on floors, or a retractable spur which may be thrust into the ground when the tripod is used out-of-doors. A linkage system is for rigidly interconnecting three legs of the tripod when the same is in an expanded position for use. A latch mechanism is for simultaneously latching the legs in a closed position when the tripod is folded for transportation. An under side of a head is readily accessible for attaching or detaching tilt heads and other objects on the top of the tripod.

FANTONI, MARCO

SUPPORT FOR THE SEAT OF A CHAIR

U.S. Pat. No. 3,827,750

A chair with an integral support includes a horizontal hub extending in the vertical plane of symmetry of the chair. Two sets of brackets extend laterally from the hub and are arranged symmetrically in respect of the plane. Two strips extend substantially horizontally and parallel to the plane. Each of the strips interconnect the outer ends of the brackets of a respective one of the sets. A seat having turned-down lateral edges extending substantially horizontally and parallel to the plane and shaped to conform to the upper support surfaces of the strips is mounted on the support by engaging the seat edges with the strips.

DANIELS, MICHAEL

PASSIVE FLEXION CHAIR FOR PHYSICAL THERAPY

U.S. Pat. No. 5,040,522

A flexion chair apparatus for the continuous passive motion treatment is disclosed, for use in the physical rehabilitation of a knee joint, which allows a patient to be so treated in a sitting upright position while not requiring the patient's leg to be lifted above the ground. The apparatus of the invention includes a seat and back support, as well as securement for the patient's leg and a flexing of his or her knee joint. The seat portion of the apparatus is provided with an elevator which allows the seat to be vertically and continuously or discontinuously raised and lowered during the treatment process. Securement of the patient's leg includes a support bar which runs substantially along the length of the patient's entire leg and which includes a joint adjacent to the patient's knee joint. The support bar of the invention is capable of being raised or lowered in response to a vertical movement of the seat. The patient's foot is secured to the ground in a fixed manner which does not permit it to be raised.

PELLY, CHARLES W.

VEHICLE SEAT

U.S. Pat. No. Des. 249,102

The ornamental design for a vehicle seat as shown.

KUHL, POUL

MOELLER, FLEMMING

ERNST, ERIK

MOBILE CHAIR

U.S. Pat. No. Des. 327,041

The ornamental design for a mobile chair, as shown and described.

Figure 1:
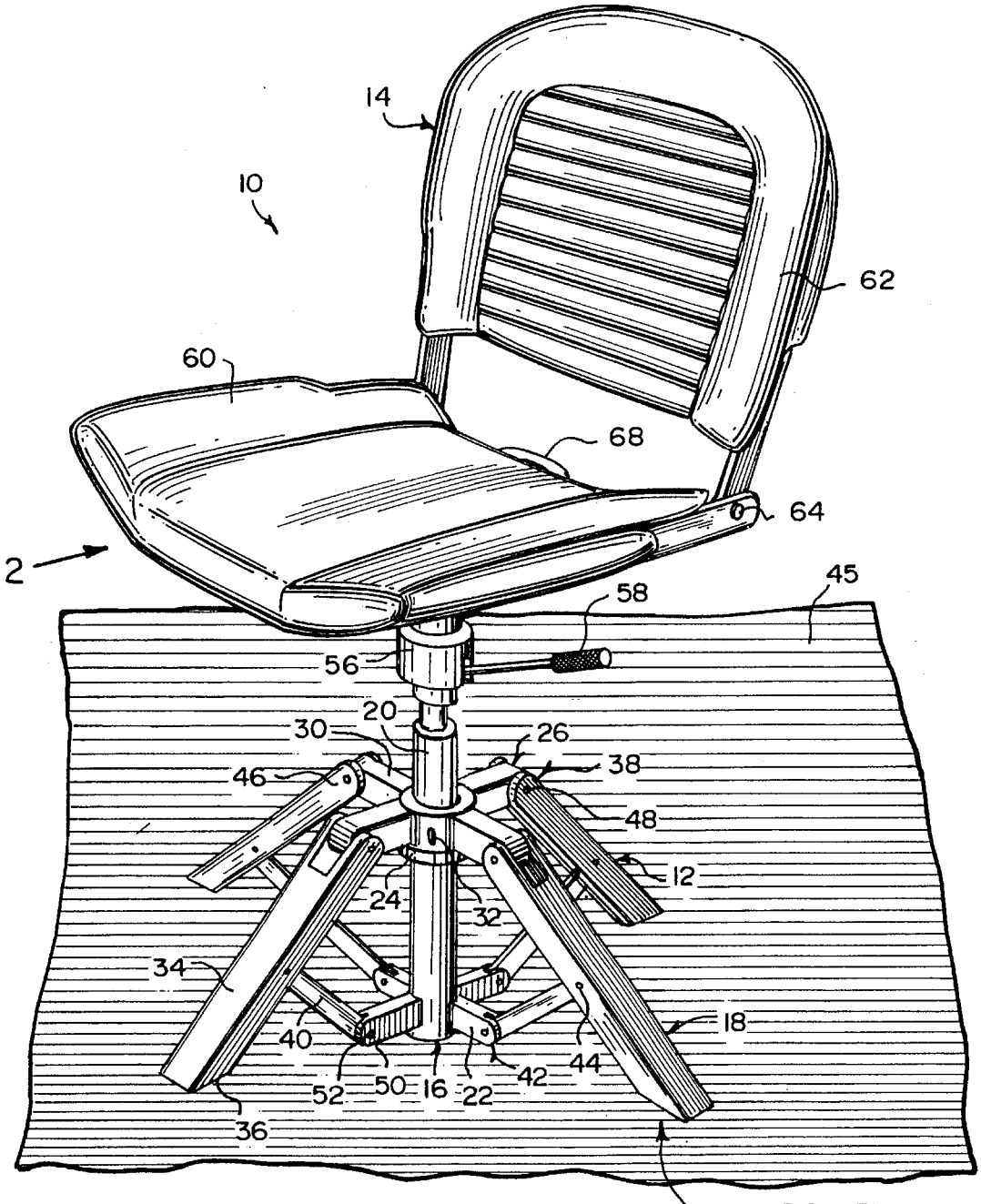
FIG. 1 is a front elevational view of the vehicle seat showing the new design.

FIG. 1 is a top, front and right side perspective view of a mobile chair showing the new design.

Figure 2:
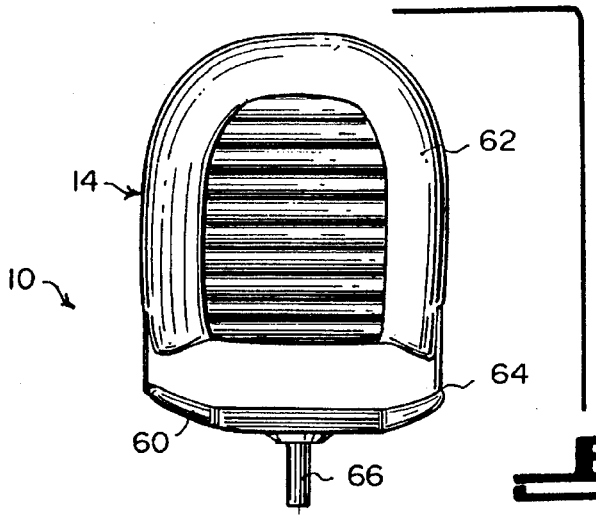
FIG. 2 is a side elevational view thereof, the opposite side being a mirror image of the side shown herein.

FIG. 2 is a rear perspective view thereof.

Figure 3:
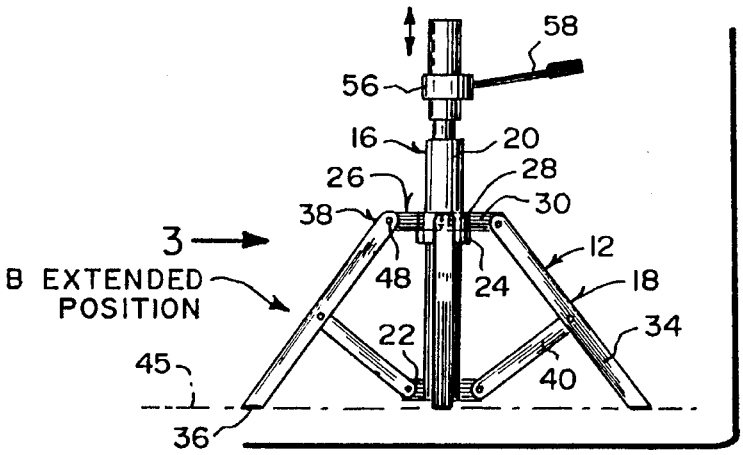
FIG. 3 is a top plan view thereof.
Figure 3:
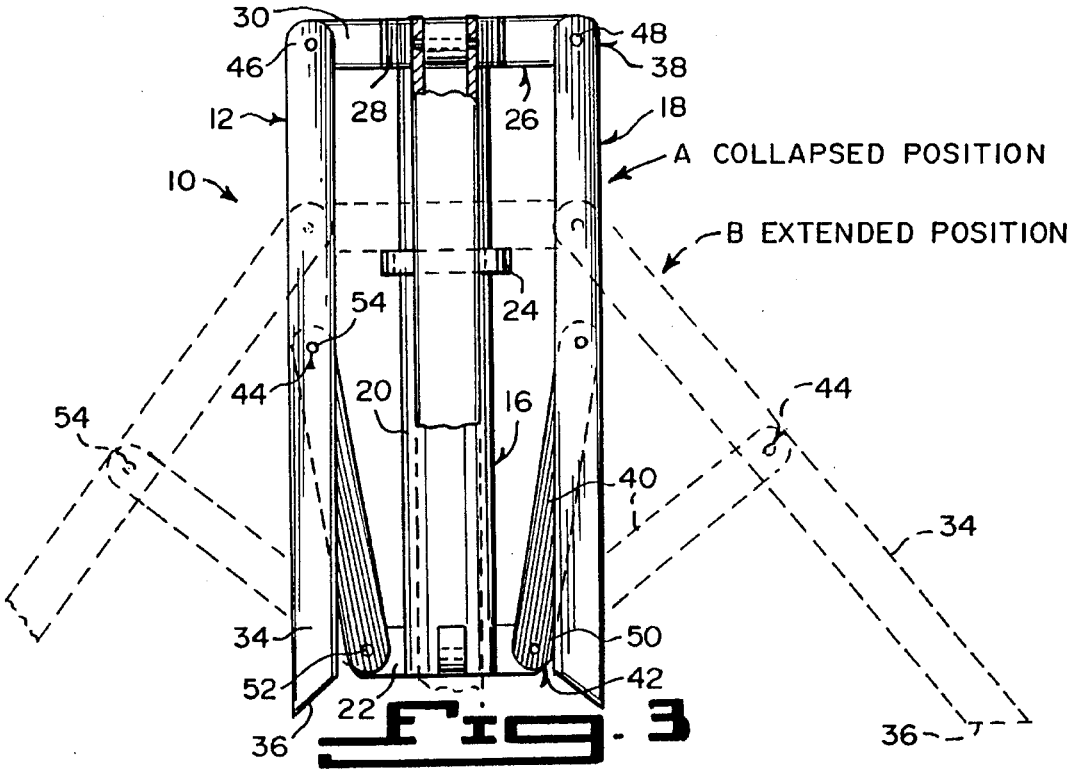

FIG. 3 is a top and front perspective view of the support frame of the mobile chair.

Figure 4:
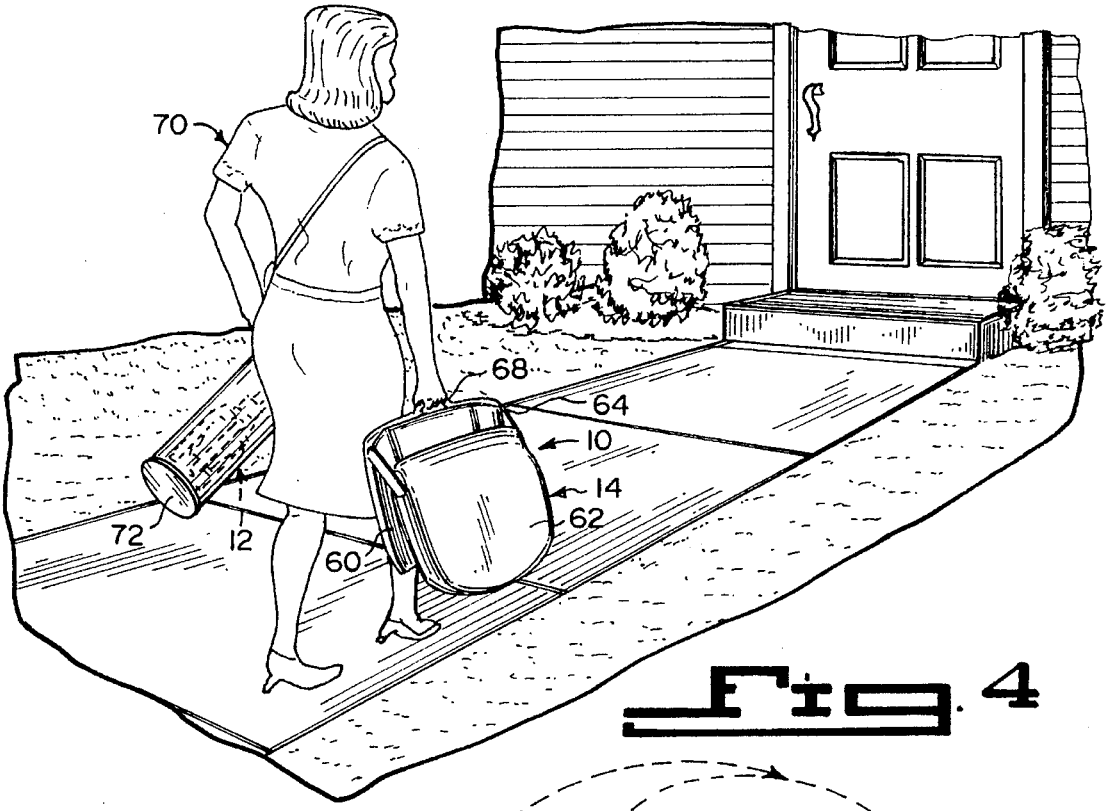
FIG. 4 is a rear elevational view thereof.

FIG. 4 is a top, front and right side perspective view of the seat of the mobile chair.

Figure 5:
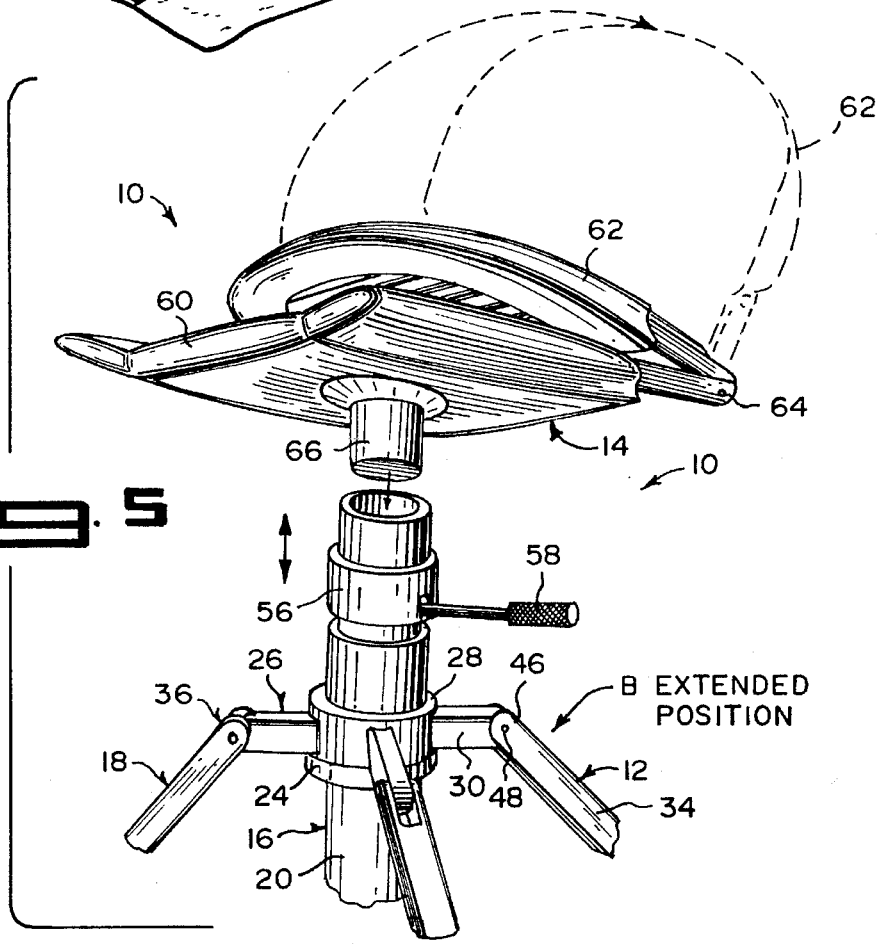
FIG. 5 is an enlarged, front perspective view thereof.

FIG. 5 is a bottom and left side perspective view of the seat of the mobile chair.

STIDD, ROBERT

HELM CHAIR

U.S. Pat. No. Des. 336,791

The ornamental design for a helm chair, as shown and described.

FIG. 1 is a perspective view of the ornamental design for a helm chair.

FIG. 2 is a front elevational view of the design as shown in FIG. 1.

FIG. 3 is a rear view of the design as shown in FIG. 1.

FIG. 4 is a left side elevational view of the design as shown in FIG. 1.

FIG. 5 is a right side elevational view of the design as shown in FIG. 1.

FIG. 6 is a top plan view of the design as shown in FIG. 1.

FIG. 7 is a bottom view of the design as shown in FIG. 1.

FIG. 8 is a perspective view of another embodiment of the ornamental design for a helm chair.

FIG. 9 is a front elevational view of the design as shown in FIG. 8.

FIG. 10 is a rear elevational view of the design as shown in FIG. 8.

FIG. 11 is a left side elevational view of the design as shown in FIG. 8.

FIG. 12 is a right side elevational view of the design as shown in FIG. 8.

FIG. 13 is a top plan view of the design as shown in FIG. 8.

FIG. 14 is a bottom view of the design as shown in FIG. 8.

ROZUM, JAMES W.

COMBINED SEAT AND LIFE PRESERVER CUSHION

U.S. Pat. No. Des. 350,649

The ornamental design for a combined seat and life preserver cushion, as shown and described.

FIG. 1 is a front elevational view of the combined seat and life preserver cushion showing the new design.

FIG. 2 is a rear elevational view thereof.

FIG. 3 is a left side elevational view thereof.

FIG. 4 is a right side elevational view thereof.

FIG. 5 is a top plan view thereof.

FIG. 6 is a bottom plan view thereof.

FIG. 7 is an isometric view showing the seat with the life preserver cushion detached and in reverse condition for illustrative purposes.

SUMMARY OF THE INVENTION

A primary object of the present invention is to provide a portable hair styling and barber chair that will overcome the shortcomings of the prior art devices.

Another object is to provide a portable hair styling and barber chair that is lightweight and can be disassembled, so that it can be carried with little effort from place to place and can conveniently fit into a trunk of an automobile.

An additional object is to provide a portable hair styling and barber chair that consists of two detachable parts being a seat and base unit, having stable, solid legs and an adjustable shaft to raise and lower the seat.

A further object is to provide a portable hair styling and barber chair that is simple and easy to use.

A still further object is to provide a portable hair styling and barber chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 1 is a perspective view of the instant invention assembled.

FIG. 2 is a front view taken in the direction of arrow 2 in FIG. 1, showing the seat assembly separated from the base unit.

FIG. 3 is an enlarged elevational view taken in the direction of arrow 3 in FIG. 2, of the tetrapod portion of the base unit with parts broken away and in section.

FIG. 4 is a perspective view showing the instant invention disassembled and being carried by a person to a house.

FIG. 5 is a perspective view with parts broken away, showing the seat assembly ready to be assembled onto the base unit.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 5 illustrate a portable hair styling and barber chair 10, comprising a lightweight collapsible tetrapod bass unit 12. A lightweight foldable seat assembly 14 fits upon the base unit 12. When the seat assembly 14 is disassembled from the base unit 12, the chair 10 can be carried with little effort from place to place and can conveniently fit into a trunk of an automobile.

The base unit 12 includes a center post 16. Four leg subassemblies 18 are radially hingedly secured about the center post 16. They support the center post 16 in an upright position when the leg assemblies 18 go from a collapsed position A against the center post 16 to an extended position B.

The center post 16 consists of a hollow cylindrical column 20. Four stationary lugs 22 are radially attached about a bottom end of the column 20. An annular stop 24 is affixed to the column 20 approximately one third the distance down from a top end of the column 20. A slide swivel 26 is carried on the column 20 between the annular stop 24 and the top end thereof.

The slide swivel 26 contains a collar 28, which rides upon the column 20. Four arms 30 are radially attached about the collar 28. A setscrew 32 is for securing the collar 28 to the column 20, when the leg assemblies 18 are in the extended position B.

Each leg subassembly 18 includes a leg 34 having an approximately forty degree bevel cut foot 36 formed on a lower end thereof. A first structure 38 is for pivotally securing an upper end of the leg 34 to one of the arms 30 of the slide swivel 26. A strut 40 is provided. A second structure 42 is for pivotally securing a first end of the strut 40 to one stationary lug 22 on the column 20. A third structure 44 is for pivotally securing a second end of the strut 40 to the leg 34 approximately half the distance down from the upper end of the leg 34. The foot 36 of the leg 34 can rest safely upon a flat surface 45, when the leg 34 is in the extended position B.

The first pivotally securing structure 38 consists of the leg 34 having a forked part 46 integrally formed on the upper end. A distal end of the arm 30 of the slide swivel 26 can fit into the forked part 46. A first pivot pin 48 extends through the forked part 46 of the leg 34 and the distal end of the arm 30.

The second pivotally securing structure 42 comprises the stationary lug 22 having a forked part 50 integrally formed on a distal end. The first end of the strut 40 can fit into the forked part 50. A second pivot pin 52 extends through the forked part 50 of the stationary lug 22 and the first end of the strut 40.

The third pivotally securing structure 44 includes a third pivot pin 54, to extend through the second end of the strut 40 and the leg 34. The base unit 12 further contains a height adjuster member 56, having a control lever 58. The height adjuster member 56 is mounted onto the column 30, so as to raise and lower the seat assembly 14 therefrom.

The seat assembly 14 includes a seat 60. A backrest 62 is hinged to the seat 60 at 64. A spindle 66 extends downwardly from a lower surface of the seat 60, to engage with the height adjuster member 56. A handle 68 is affixed to a rear edge of the seat 60. When the spindle 66 is removed from the height adjuster member 56 and the backrest 62 is folded down upon the seat 60, the seat assembly 14 can be easily transported by a person 70 grasping the handle 68, as shown in FIG. 4.

A carry case 72 is of a size and shape to retain the base unit 12 therein, when the leg assemblies 18 are in the collapsed position A. The base unit 12 can be easily transported by the person 70 holding the carry case 72.

LIST OF REFERENCE NUMBERS

A collapsed position of 18
B extended position of 18
10 portable hair styling and barber chair
12 lightweight collapsible tetrapod base unit of 10
14 lightweight foldable seat assembly of 10
16 center post of 12
18 leg subassembly of 12
20 hollow cylindrical column of 16
22 stationary lug on 20
24 annular stop on 20
26 slide swivel on 20
28 collar of 26
30 arm on 28
32 setscrew for 28
34 leg of 18
36 foot of 34
38 first pivotally securing structure
40 strut of 18
42 second pivotally securing structure
44 third pivotally securing structure
45 flat surface
46 forked part of 34
48 first pivot pin of 38
50 forked part of 22
52 second pivot pin of 42
54 third pivot pin of 44
56 height adjuster member in 12
58 control lever of 56
60 seat of 14
62 backrest of 14
64 hinge for 62 on 60
66 spindle
68 handle
70 person
72 carry case It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable hair styling and barber chair comprising:

a) a lightweight collapsible tetrapod base unit comprising a vertically extending center post formed by a hollow cylindrical column having four stationary lugs radially attached about a bottom end of said column, an annular stop affixed to said column approximately one third the distance down from a top end of said column, and swivel means slidable on said column between said annular stop and the top end of said column;

b) said swivel means comprising a collar which rides upon said column, four arms rigidly attached at one end each about said collar and extending horizontally outwardly, said about aligned with said stationary lugs, and a set screw for securing said collar to said column at a selected position along said column;

c) leg subassembly means for each aligned arm and lug for supporting said column in an upright position comprising a leg having an approximately forty degree bevel cut foot formed on a lower end thereof and a forked part at an upper end thereof, means for pivotally securing the upper end of said leg to said arm comprising said forked part straddling an outer end of said arm and a first pivot pin extending through said forked part and the outer end of said arm, a strut having means for pivotally securing a first end to the stationary lug comprising a forked part to engage said stationary lug with a second pivot pin extending therethrough and means comprising a third pivot pin for pivotally securing a second end of said strut to said leg approximately half the distance down from the upper end of said leg, so that said foot of said leg can rest safely upon a supporting flat surface when said leg is in an extended position, said leg being adjustable between a collapsed position in which said swivel means is moved to an upper end of said column with said strut extending up from said lug substantially along a side of said column and said leg extending downwardly from said swivel means substantially along said column and said extended position in which said swivel means is moved down from the top end of said column to said selected position above said annular stop with said foot of said leg extending outwardly and said strut pivoted outwardly about said lug;

d) a lightweight foldable seat assembly which fits upon said base unit, so that when said seat assembly is disassembled from said base unit, said chair can be carried with little effort from place to place and can conveniently fit into a trunk of an automobile, said seat assembly comprising a seat, a backrest hinged to said seat, a spindle extending downwardly from a lower surface of said seat to engage said column, and a handle affixed to a rear edge of said seat to facilitate transporting said seat when said backrest is folded down and said seat is removed from said base unit; and e) said base including means having a lever for adjusting the height of said seat assembly on said column.

* * * * *